US009463912B2

(12) United States Patent
Liu

(10) Patent No.: US 9,463,912 B2
(45) Date of Patent: Oct. 11, 2016

(54) LID WITH A DATE DISPLAY

(71) Applicant: Free-Free Industrial Corp., Taipei (TW)

(72) Inventor: Sheng-Yu Liu, Taipei (TW)

(73) Assignee: FREE-FREE INDUSTRIAL CORP., Taipei (TW)

( * ) Notice: Subject to any disclaimer, the term of this patent is extended or adjusted under 35 U.S.C. 154(b) by 246 days.

(21) Appl. No.: 14/466,738

(22) Filed: Aug. 22, 2014

(65) Prior Publication Data

US 2016/0052684 A1 Feb. 25, 2016

(51) Int. Cl.
*B65D 51/24* (2006.01)

(52) U.S. Cl.
CPC ..... *B65D 51/245* (2013.01)

(58) Field of Classification Search
CPC ..... B61D 51/245
USPC ..... 116/307
See application file for complete search history.

(56) References Cited

U.S. PATENT DOCUMENTS

| | | | | |
|---|---|---|---|---|
| 3,392,468 | A * | 7/1968 | Wolf | B65D 51/245 116/307 |
| 5,529,179 | A * | 6/1996 | Hanson | B65D 51/2821 206/217 |
| 2003/0015450 | A1* | 1/2003 | Ferretti | B65D 43/0212 206/459.1 |
| 2004/0232026 | A1* | 11/2004 | Goeking | A47J 36/027 206/459.1 |
| 2011/0297573 | A1* | 12/2011 | Chen | B65D 1/02 206/459.5 |
| 2011/0303572 | A1* | 12/2011 | Rajpoot | B65D 1/0223 206/459.5 |
| 2013/0313147 | A1* | 11/2013 | Bahrami | B65D 23/00 206/459.5 |

* cited by examiner

*Primary Examiner* — Daniel S Larkin
*Assistant Examiner* — Irving A Campbell
(74) *Attorney, Agent, or Firm* — Haynes and Boone, LLP

(57) ABSTRACT

A lid includes a cover plate and at least one date display device. The cover plate includes at least one mounting area having a plurality of through holes. The date display device includes a plurality of digital display units each having a plurality of flexible protruding membranes to form a digit pattern. The protruding membranes are able to be selectively bent upward or downward to change the digit pattern. Each flexible protruding membrane is foldedly connected to the mounting area, covers a respective through hole, and is convertible between a protruding configuration that protrudes upward from the respective through hole and an indenting configuration that indents downward from the respective through hole.

9 Claims, 6 Drawing Sheets

LID WITH A DATE DISPLAY

FIELD OF THE INVENTION

The invention relates to a lid, more particularly to a lid that can display a storage date.

BACKGROUND OF THE INVENTION

To prevent contact of food or dish with air which may cause deterioration thereof, the food is usually stored in a container. However, when the number of the container is increased, a user may forget the expiry date of the food contained therein, so that the food is expired or even spoiled, thereby causing food waste. A container with a lid having an electronic display panel is currently available in the market. The electronic display panel can display an expiry date of the food. However, the structure of the lid is complicated, and requires the use of battery, so that not only is the manufacturing cost increased, but also it does not meet the demand for friendly environment and energy conservation.

SUMMARY OF THE INVENTION

Therefore, an object of the present invention is to provide a lid that has a simple structure, that does not need electricity and that can display and adjust a storage date.

Accordingly, a lid comprises a cover plate including at least one mounting area having a plurality of through holes, and at least one date display device disposed in the mounting area and including a plurality of digital display units each having a plurality of flexible protruding membranes to form a digit pattern. The protruding membranes are able to be selectively bent upward or downward to change the digit pattern. Each flexible protruding membrane is foldedly connected to the at least one mounting area and covers a respective one of the through holes. Each flexible protruding membrane is convertible between a protruding configuration that protrudes upward from the respective through hole and an indenting configuration that indents downward from the respective through hole.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE EMBODIMENTS

Figure 1:
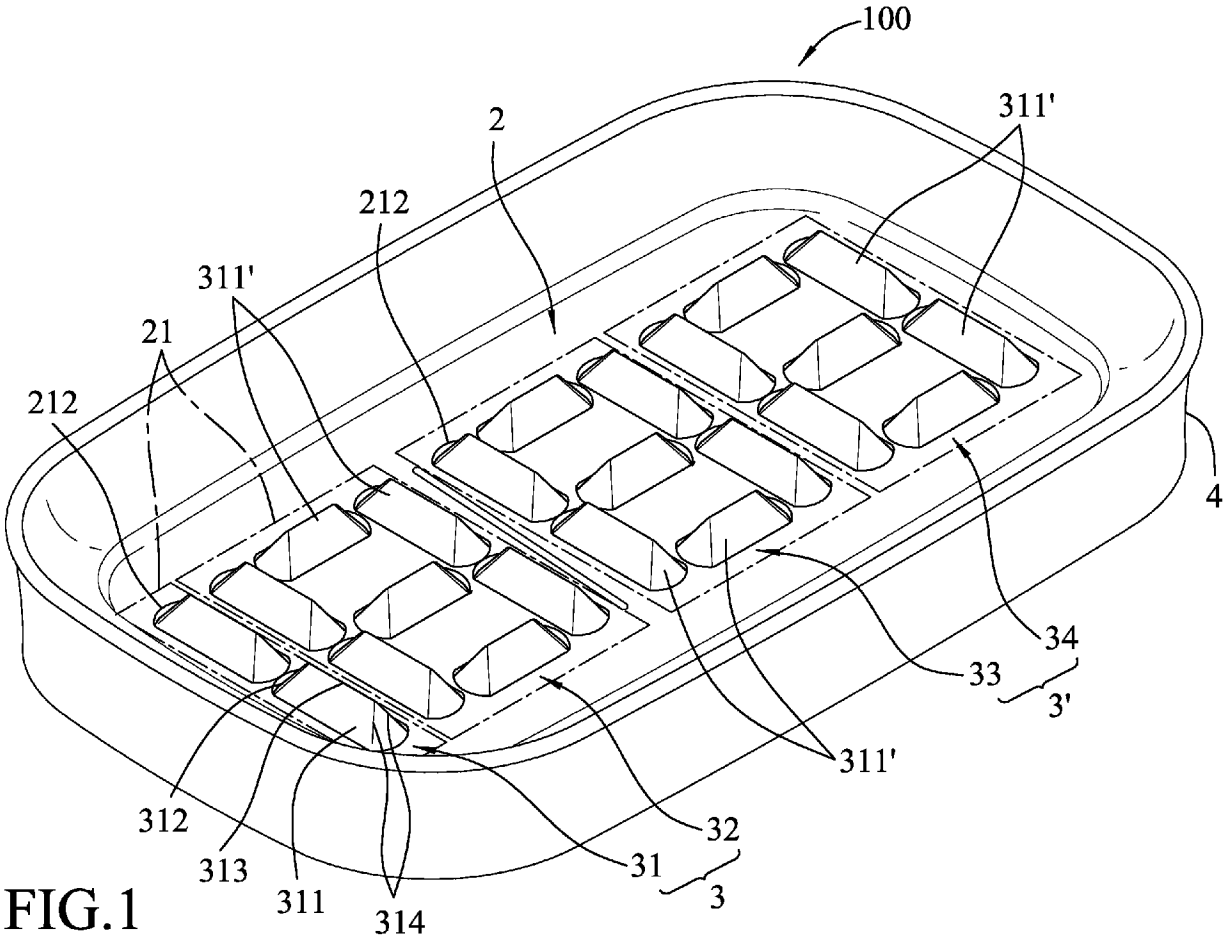
FIG. 1 is a perspective view of the first embodiment of a lid according to the present invention.
Figure 2:
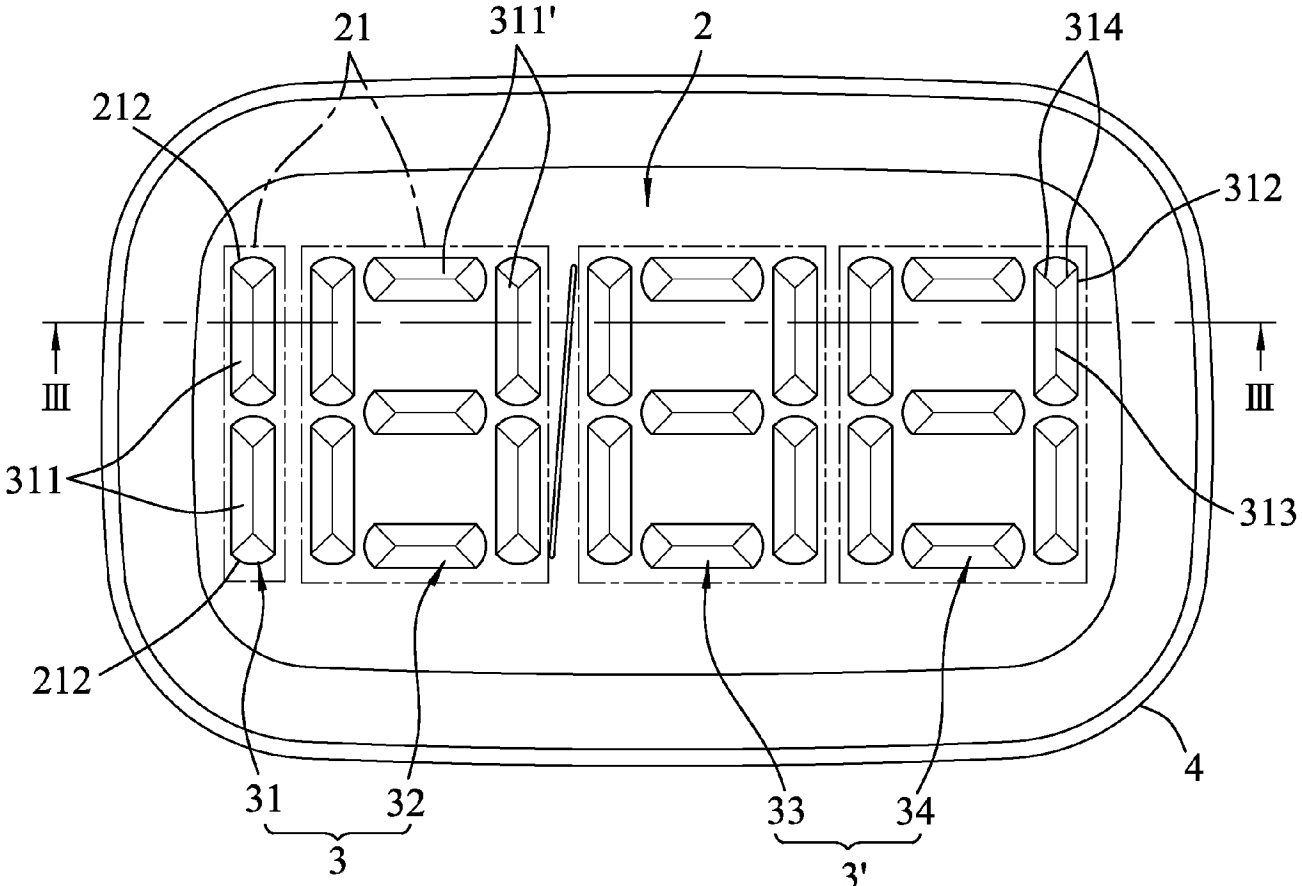
FIG. 2 is a schematic view of the first embodiment.
Figure 3:
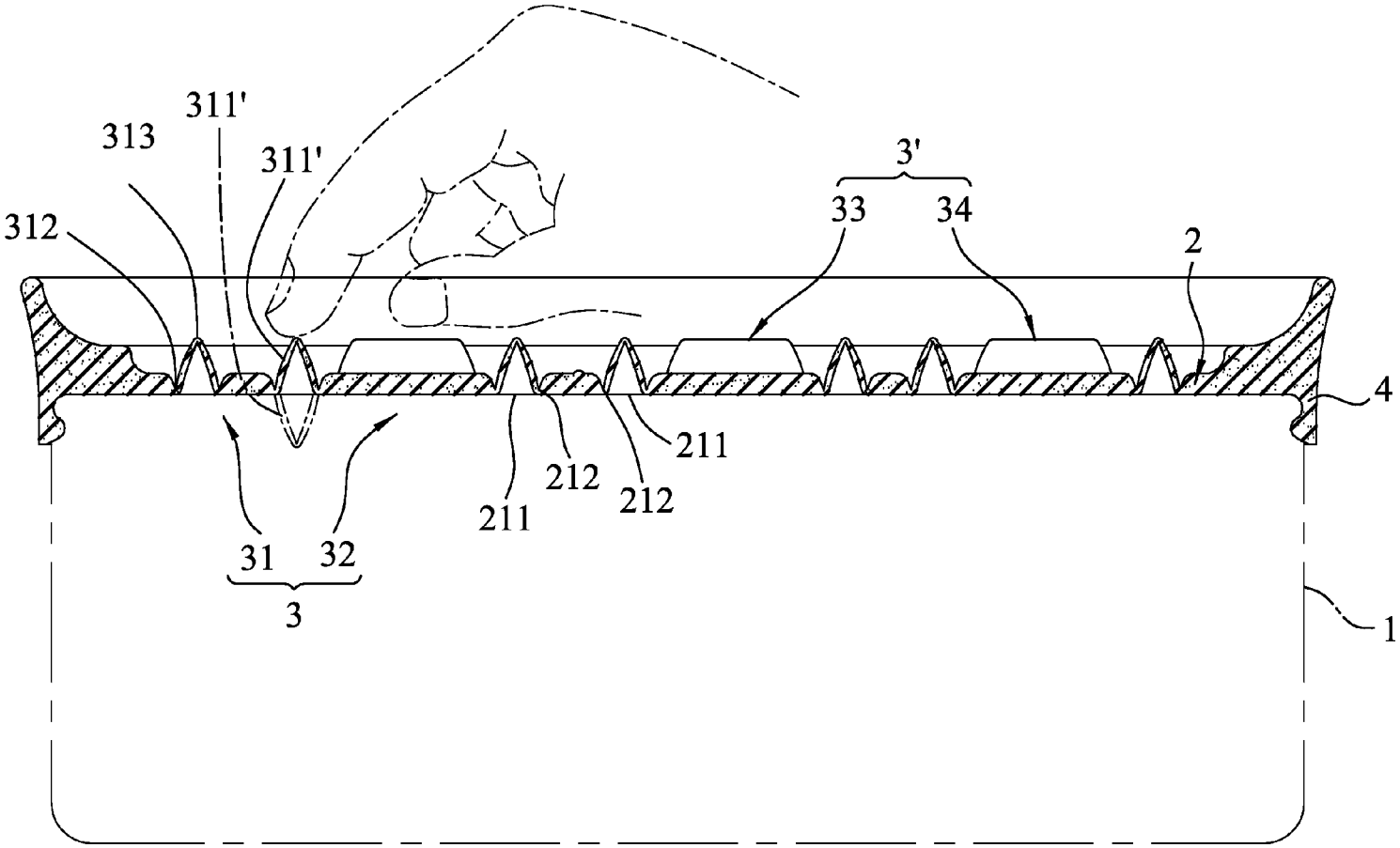
FIG. 3 is a sectional view of the first embodiment taken along line III-III of FIG. 2.

Before the present invention is described in greater detail with reference to the accompanying embodiments, it should be noted herein that like elements are denoted by the same reference numerals throughout the disclosure.

Referring to FIGS. 1 to 5, a lid 100 according to the first embodiment of the present invention is suitable for removably covering a container body 1 which is used for containing food or other articles. The lid 100 comprises a cover plate 2, two date display devices 3, 3', and an engaging portion 4 integrally connected to a periphery of the cover plate 2 for detachably or tightly engaging with the container body 1.

In this embodiment, each of the cover plate 2 and the engaging portion 4 is made of a flexible material, such as rubber or silicone. However, in actual practice, each of the cover plate 2 and the engaging portion 4 may be made of a hard material, and is not limited to the disclosed embodiment. The cover plate 2 is substantially flat, and is configured to cover an open end of the container body 1. The cover plate 2 includes four mounting areas 21, but is not limited thereto. The number of the mounting area 21 may be increased or decreased depending on the number of digits of the date to be displayed. Each mounting area 21 includes a plurality of elongated through holes 211 each defined by a hole wall 212. Alternatively, each through hole 211 may be curved, circular or other shapes, and is not limited to the disclosed embodiment.

Each of the date display devices 3, 3' is integrally connected to the cover plate 2, and is made of a flexible material, such as rubber or silicone. In this embodiment, a first one of the date display devices 3, 3' displays a month (January to December) of a year, while a second one of the date display devices 3, 3' displays a day (1 to 31) of a month. Alternatively, the date display device 3 or 3' may also be used to display year, a day of a week, or time. The lid 100 may also be configured to include only one date display device 3, or three or more of the same. The first date display device 3 includes a first display unit 31 for displaying a tens digit, and a second display unit 32 for displaying a units digit. The second date display device 3' includes a third display unit 33 for displaying a tens digit, and a fourth display unit 34 for displaying a units digit.

The first display unit 31 has a two-segment structure for displaying numeral "1" or nothing at all, and includes two flexible protruding membranes 311 extending and spaced apart in a front-rear direction. Each of the second, third and fourth display units 32, 33, 34 has a seven-segment structure for displaying a selected one of the numerals "0"~"9" and includes seven flexible protruding membranes 311' each having a structure similar to that of the protruding membrane 311. Three of the protruding membranes 311' extend in a left-right direction and are spaced apart in the front-rear direction. The other four protruding membranes 311' are in pairs. The pairs of the protruding membranes 311' extend in the front-rear direction, and are spaced apart from each other in the left-right direction. The protruding membranes 311, 311' form a digit pattern, and are able to be selectively bent upward or downward to change the digit pattern.

Each of the protruding membranes 311, 311' has a periphery integrally and foldedly connected to the hole wall 212 of a respective through hole 211, and covers the respective through hole 211. Each protruding membrane 311, 311' has an elongated shape corresponding to that of the respective through hole 211, and has a junction fold line 312 formed in a junction between a periphery of one of the protruding membranes 311, 311' and a periphery of the hole wall 212 of the respective through hole 211, a top fold line 313 extending in a length direction thereof, and two pairs of side fold lines 314 each pair of which form an angle therebetween and extend from one end of the top fold line 313 away from each other toward the junction fold line 312 in an inclined manner. Through the presence of the junction, top and side fold lines 312, 313, 314, when each protruding membrane 311, 311' is pressed, it is pliable and easily deformed. However, each protruding membrane 311, 311' may be dispensed with the junction, top and side fold lines 312, 313, 314, and is not limited to the aforesaid disclosure.

Each protruding membrane 311, 311' is convertible between a protruding configuration and an indenting configuration. In the protruding configuration, each protruding membrane 311, 311' protrudes upward from a surface of the corresponding mounting area 21, and has a substantially inverted V-shaped cross section, as shown in solid lines in FIG. 3. To shift the protruding membrane 311, 311' from the protruding configuration to the indenting configuration, each protruding membrane 311, 311' is pressed by one or two fingers of the user to move gradually downward from the surface of the corresponding mounting area 21 and outward from the respective through hole 211 until each protruding membrane 311, 311' indent downward from the respective through hole 211. Each protruding membrane 311, 311' has a substantially V-shaped cross section in the indenting configuration. One of the protruding membranes 311 in the indenting configuration is shown in phantom line in FIG. 3. Further, when the user pushes upward each protruding membrane 311, 311' in the indenting configuration, each protruding membrane 311, 311' can be shiftedback to the protruding configuration.

Figure 4:
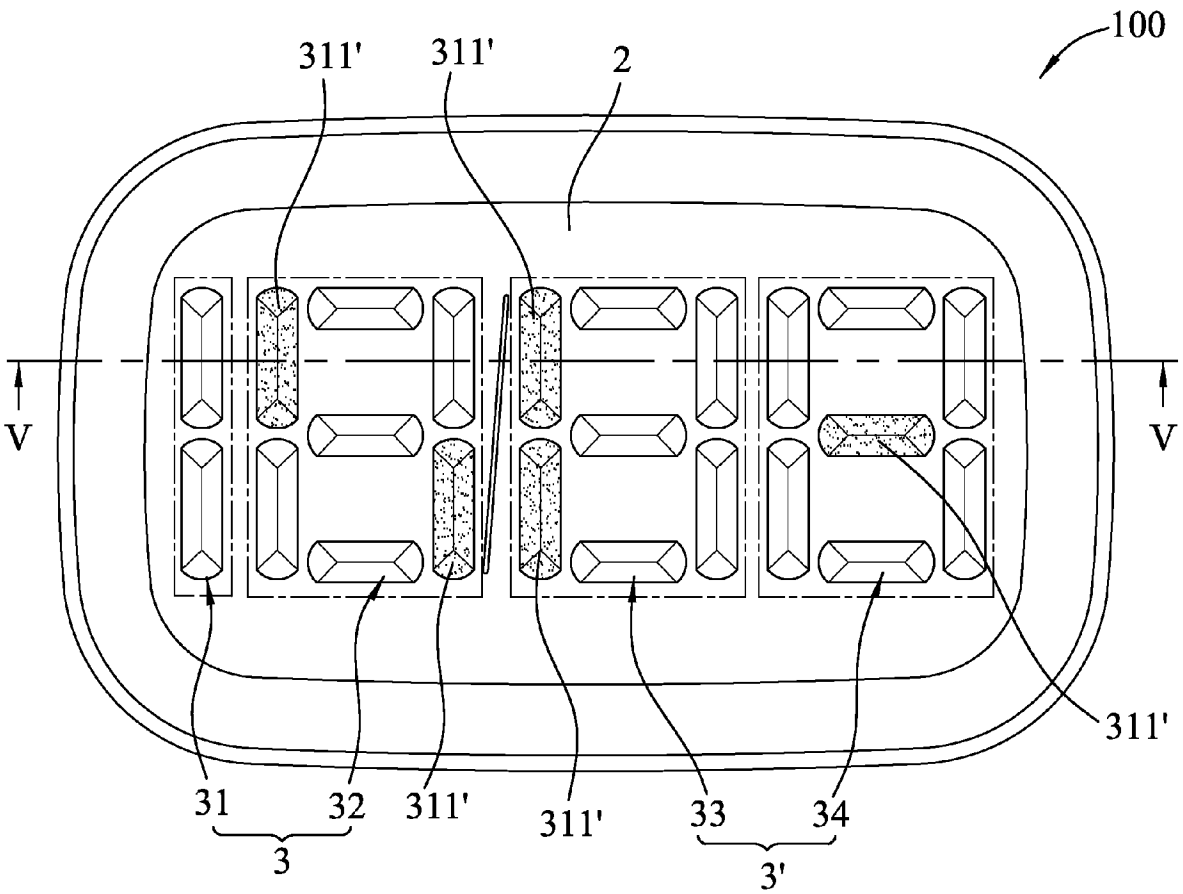
FIG. 4 is a view similar to FIG. 2, but with a date being set.
Figure 5:
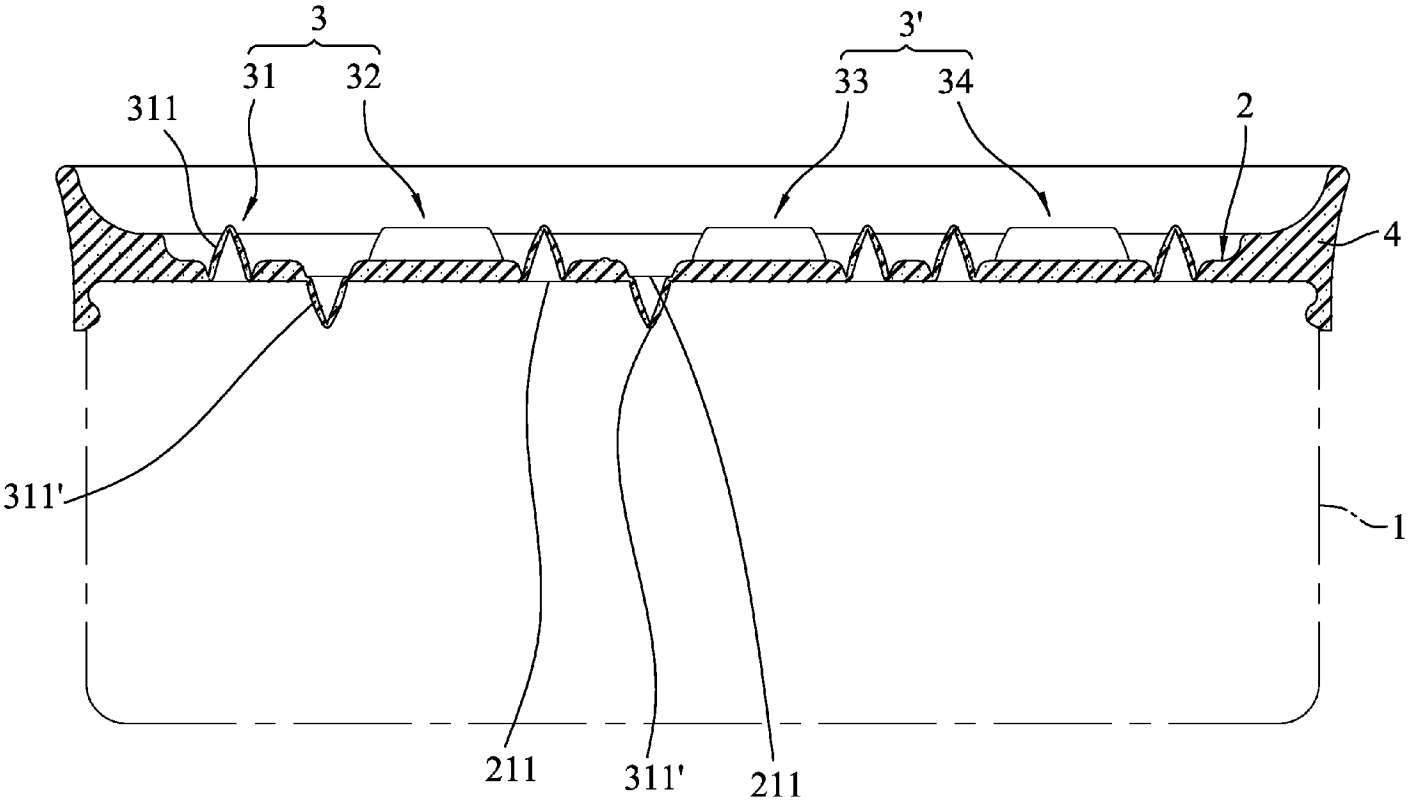
FIG. 5 is a sectional view of the first embodiment taken along line V-V of FIG. 4.

To use the lid 100, all the protruding membranes 311, 311' are first placed in the protruding configuration, after which a date may be set before or after the lid 100 covers the container body 1. To set a date, a portion of the protruding membranes 311, 311' is pressed to the indenting configuration, so that the other portion of the protruding membranes 311, 311' remains in the protruding configuration. Thus, a digit pattern that conforms to the date set by the user is obtained. For example, as shown in FIGS. 4 and 5, the date to be set is December 30, the user presses downward the protruding membrane 311 in an upper left corner and the protruding membrane 311 in a lower right corner of the second display unit 32, the left pair of the protruding membranes 311' of the third display unit 33, and the middle protruding membrane 311' of the fourth display unit 34 so as to place these protruding membranes 311, 311' in the indenting configuration. Through the different visual effects produced by the protruding membranes 311, 311' in the indenting and protruding configurations, the set date "12/30" is clearly displayed on the lid 100. Hence, the lid 100 can achieve the purpose of displaying the date set by the user. Moreover, if it is desired to reset the date, the protruding membranes 311, 311' in the indenting configuration are first pushed back to the protruding configuration, after which the protruding membranes 311, 311' are selectively pressed to the indenting configuration to display the desired reset date on the lid 100.

Alternatively, the protruding membranes 311, 311' in the indenting configuration may have a digit pattern conforming to a desired date set by the user.

Figure 6:
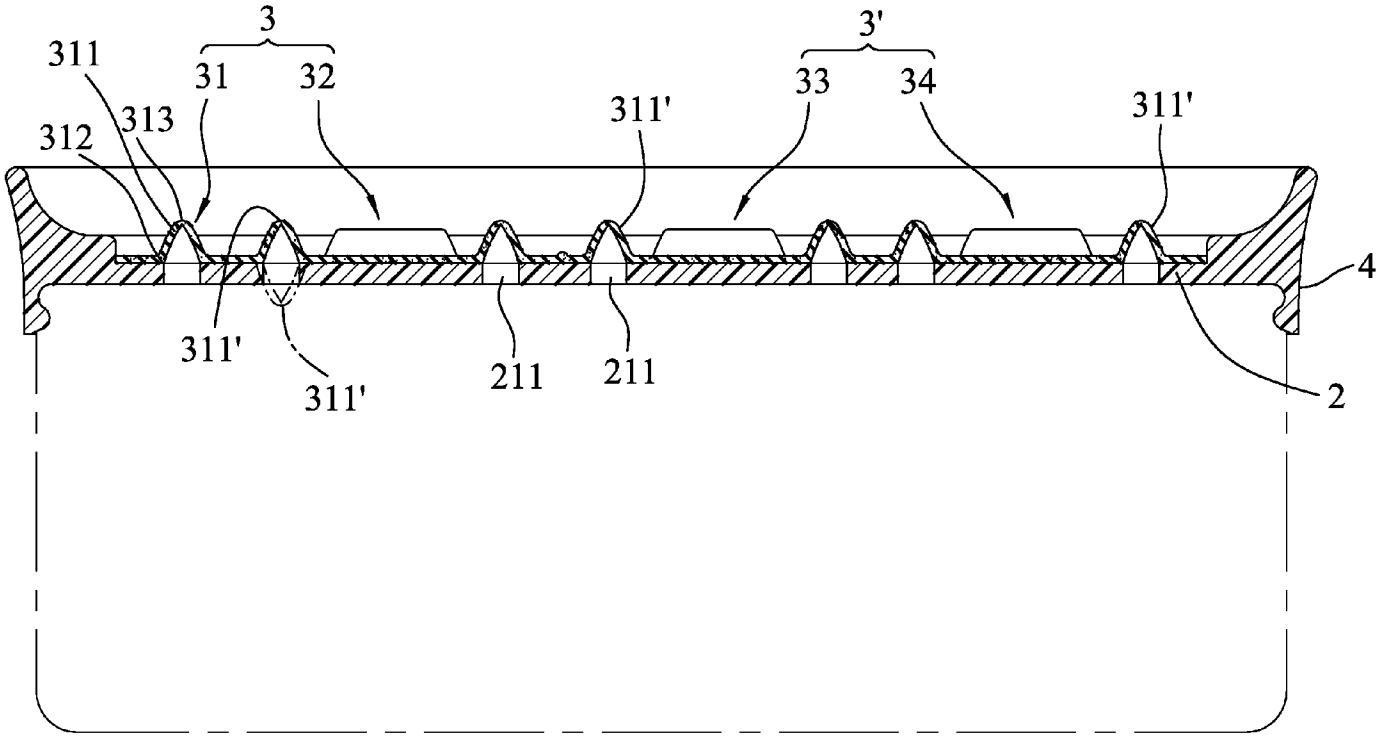
FIG. 6 is a sectional view of the second embodiment of the lid according to the present invention.

Referring to FIG. 6, the second embodiment of the lid 100 according to the present invention is shown to be substantially identical to the first embodiment. However, in this embodiment, the first and second date display devices 3, 3' are integrally connected to form a one-piece flexible pad which is made of rubber or silicone and which is adhered to the cover plate 2. The protruding membranes 311, 311' of the first and second display devices 3, 3' correspond in position to and are located above the through holes 211. Similarly, each protruding membrane 311, 311' is convertible between the protruding configuration (shown in solid line) and the indenting configuration (shown in phantom line).

In sum, through the flexibility of the protruding membranes 311, 311', and without the need to use electricity, the user himself/herself can press the protruding membranes 311, 311' so as to convert some of the protruding membranes 311, 311' from the protruding configuration to the indenting configuration. Through the different visual effects produced by the protruding and indenting protruding membranes 311, 311', a desired date may be seen displayed on the lid 100. As such, not only setting and resetting of the date displayed on the lid 100 can be achieved through a simple structure, but the lid 100 of the present invention can also meet the demand for friendly environment and energy conservation. Therefore, the object of the present invention can be realized.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A lid comprising:

a cover plate including at least one mounting area having a plurality of through holes; and at least one date display device disposed in said mounting area and including a plurality of digital display units each having a plurality of flexible protruding membranes to form a digit pattern, said protruding membranes being able to be selectively bent upward or downward to change said digit pattern, each of said flexible protruding membranes being foldedly connected to said at least one mounting area and covering a respective one of said through holes, each of said flexible protruding membranes being convertible between a protruding configuration that protrudes upward from the respective said through hole and an indenting configuration that indents downward from the respective said through hole.

2. The lid as claimed in claim 1, wherein said lid comprises two said mounting areas and two said date display devices respectively disposed in said mounting areas, a first one of said date display device displaying a month of a year, a second one of said date display device displaying a day of a month, said first date display device including a first display unit for displaying a tens digit, and a second display unit for displaying a units digit, said second date display device including a third display unit for displaying a tens digit, and a fourth display unit for displaying a units digit.

3. The lid as claimed in claim 2, wherein said first display unit has a two-segment structure, and includes two flexible protruding membranes extending and spaced apart in a front-rear direction, each of said second, third and fourth display units having a seven-segment structure, and including seven flexible protruding membranes, three of which extend in a left-right direction and spaced apart in the front-rear direction, and the remaining four of which are in pairs, which extend in the front-rear direction, and which are spaced apart in the left-right direction.

4. The lid as claimed in claim 3, wherein each of said through holes is defined by a hole wall, and a periphery of each of said flexible protruding membranes is integrally connected to said hole wall of the respective said through hole.

5. The lid as claimed in claim 2, wherein said date display devices are integrally connected to form a one-piece flexible pad which is attached to said cover plate, and said flexible protruding membranes of said date display devices correspond in position to and are located above said through holes.

6. The lid as claimed in claim 1, wherein each of said flexible protruding membranes has a inverted V-shaped cross section when in said protruding configuration, and a V-shaped cross section when in said indenting configuration.

7. The lid as claimed in claim 4, wherein each of said flexible protruding membranes has a junction fold line formed in a junction between a periphery of one of said flexible protruding membranes and a periphery of said hole wall of the respective said through hole.

8. The lid as claimed in claim 7, wherein each of said flexible protruding membranes is elongated, and further has a top fold line extending in a length direction thereof, and two pairs of side fold lines each pair of which form an angle therebetween and extend from one end of said top fold line away from each other toward said junction fold line in an inclined manner.

9. The lid as claimed in claim 1, further comprising an engaging portion integrally connected to a periphery of said cover plate for detachably engaging with a container body.

* * * * *